US010339875B2

(12) United States Patent
Lee

(10) Patent No.: US 10,339,875 B2
(45) Date of Patent: Jul. 2, 2019

(54) NON-QUADRANGULAR DISPLAY DEVICE

(71) Applicant: SAMSUNG DISPLAY CO., LTD., Yongin-si, Gyeonggi-do (KR)

(72) Inventor: Hyun Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 177 days.

(21) Appl. No.: 14/856,411

(22) Filed: Sep. 16, 2015

(65) Prior Publication Data

US 2016/0232854 A1 Aug. 11, 2016

(30) Foreign Application Priority Data

Feb. 5, 2015 (KR) ..... 10-2015-0018155

(51) Int. Cl.
*G09G 3/32* (2016.01)
*G09G 3/3291* (2016.01)
*G09G 3/20* (2006.01)

(52) U.S. Cl.
CPC ..... *G09G 3/3291* (2013.01); *G09G 3/20* (2013.01); *G09G 2300/0426* (2013.01); *G09G 2310/0232* (2013.01)

(58) Field of Classification Search
CPC ... G09G 2300/0426; G09G 2310/0264; G09G 2310/0281
See application file for complete search history.

(56) References Cited

U.S. PATENT DOCUMENTS 6,552,707 B1 * 4/2003 Fujiyoshi ..... G09G 3/3648 345/100
2001/0015715 A1 * 8/2001 Hebiguchi ..... G09G 3/3648 345/92
2004/0075628 A1 * 4/2004 Chien ..... G09G 3/3208 345/82
2005/0231455 A1 * 10/2005 Moon ..... G09G 3/3648 345/89
2009/0195481 A1 * 8/2009 Taguchi ..... G02B 5/201 345/55
2011/0193830 A1 * 8/2011 Cho ..... G09G 3/3648 345/204

(Continued)

FOREIGN PATENT DOCUMENTS

JP 2009-69768 A 4/2009
JP 2013-101369 A 5/2013

(Continued)

*Primary Examiner* — Dong Hui Liang
(74) *Attorney, Agent, or Firm* — Lewis Roca Rothgerber Christie LLP

(57) ABSTRACT

A display device according to an embodiment of the present invention includes: a plurality of data lines; a plurality of gate lines crossing the plurality of data lines; a non-quadrangular display panel including a plurality of pixels, each of the plurality of pixels being connected to one corresponding data line from among the plurality of data lines and one corresponding gate line from among the plurality of gate lines; and a data driver configured to supply a plurality of data signals to the plurality of data lines. At least one of the plurality of data lines is connected to a pixel from among the plurality of pixels in a first pixel column and another pixel in a second pixel column that is different from the first pixel column.

8 Claims, 4 Drawing Sheets

(56) References Cited

U.S. PATENT DOCUMENTS

| | | | | |
|---|---|---|---|---|
| 2012/0262641 | A1* | 10/2012 | Tsai | G09G 3/3648 349/43 |
| 2014/0118657 | A1* | 5/2014 | Duan | G02F 1/136286 349/46 |
| 2017/0200780 | A1* | 7/2017 | Im | H01L 27/3276 |

FOREIGN PATENT DOCUMENTS

| | | | |
|---|---|---|---|
| KR | 10-2011-0008939 | A | 1/2011 |
| KR | 10-2011-0078801 | A | 7/2011 |
| KR | 10-1301918 | B1 | 8/2013 |

* cited by examiner

NON-QUADRANGULAR DISPLAY DEVICE

CROSS-REFERENCE TO RELATED APPLICATION

This application claims priority to and the benefit of Korean Patent Application No. 10-2015-0018155, filed in the Korean Intellectual Property Office on Feb. 5, 2015, the content of which is incorporated herein by reference in its entirety.

BACKGROUND

1. Field

Embodiments of the present invention relate to a non-quadrangular display device.

2. Description of the Related Art

A display device is a device for displaying an image and may include a liquid crystal display (LCD), an organic light emitting diode display (OLED display), an electrophoretic display, or the like.

Further, the display device may be formed in various shapes, in addition to a rectangular shape. For example, the display device may be formed as a circular display device having a circular display area. In the circular display device, a plurality of data lines and a plurality of gate lines may cross at regions where pixels are formed in the circular display area, and the plurality of data lines and the plurality of gate lines may apply signals to the pixels to drive the display device.

However, in the circular display device, according to a structural characteristic, a load difference is generated due to a difference in the number of pixels connected to a data line extending along a center of the circular display panel and the pixels connected to a data line extending along an outer side of the circular display panel, and a deviation or variation is generated due to a difference in data charge between these data lines.

The above information disclosed in this Background section is only for enhancement of understanding of the background of the invention, and therefore, it may contain information that does not form prior art.

SUMMARY

Embodiments of the present invention provide a non-quadrangular display device for displaying a consistent image by applying the same or substantially the same load to each of the data lines.

An exemplary embodiment of the present invention provides a display device including: a plurality of data lines; a plurality of gate lines crossing the plurality of data lines; a non-quadrangular display panel including a plurality of pixels connected to one corresponding data line from among the plurality of data lines and one corresponding gate line from among the plurality of gate lines; and a data driver configured to supply a plurality of data signals to the plurality of data lines, in which at least one of the plurality of data lines is connected to a pixel from among the plurality of pixels in a first pixel column and another pixel in a second pixel column that is different from the first pixel column.

The first pixel column may be nearer to a center of the non-quadrangular display panel than the second pixel column.

The first pixel column may be near the center of the non-quadrangular display panel and the second pixel column may be near an outer side of the non-quadrangular display panel.

The non-quadrangular display panel may further include a non-quadrangular display area, in which the plurality of pixels is disposed, and a non-display area surrounding a periphery of the display area.

At least one of the plurality of data lines may connect the first pixel column and the second pixel column and may extend through a portion of the non-display area.

At least one of the plurality of data lines may connect the first pixel column and the second pixel column and may extend through the non-display area at a side of the non-quadrangular display panel that is opposite to a side of the non-quadrangular display panel at which the data driver is located.

At least one of the plurality of data lines may cross another one of the plurality of data lines outside a periphery of the display panel and may connect the first pixel column and the second pixel column.

The non-quadrangular display panel may be a circular display panel.

According to exemplary embodiments of the present invention, a data line positioned at an outer portion of a circular panel of a circular display device and a data line positioned at a center portion of the circular panel may be connected as one data line (e.g., connected to each other forming one data line), thereby reducing or minimizing a load difference due to a difference in the number of pixels connected to each of the data lines.

According to another embodiment of the present invention, a display device includes: a plurality of data lines; a plurality of gate lines crossing the plurality of data lines; a non-quadrangular display panel including a plurality of pixels each connected to one corresponding data line from among the plurality of data lines and one corresponding gate line from among the plurality of gate lines; and a data driver configured to supply a plurality of data signals to the plurality of data lines, in which each of the plurality of data lines extends across the non-quadrangular display panel at least twice.

DETAILED DESCRIPTION

Figure 1:
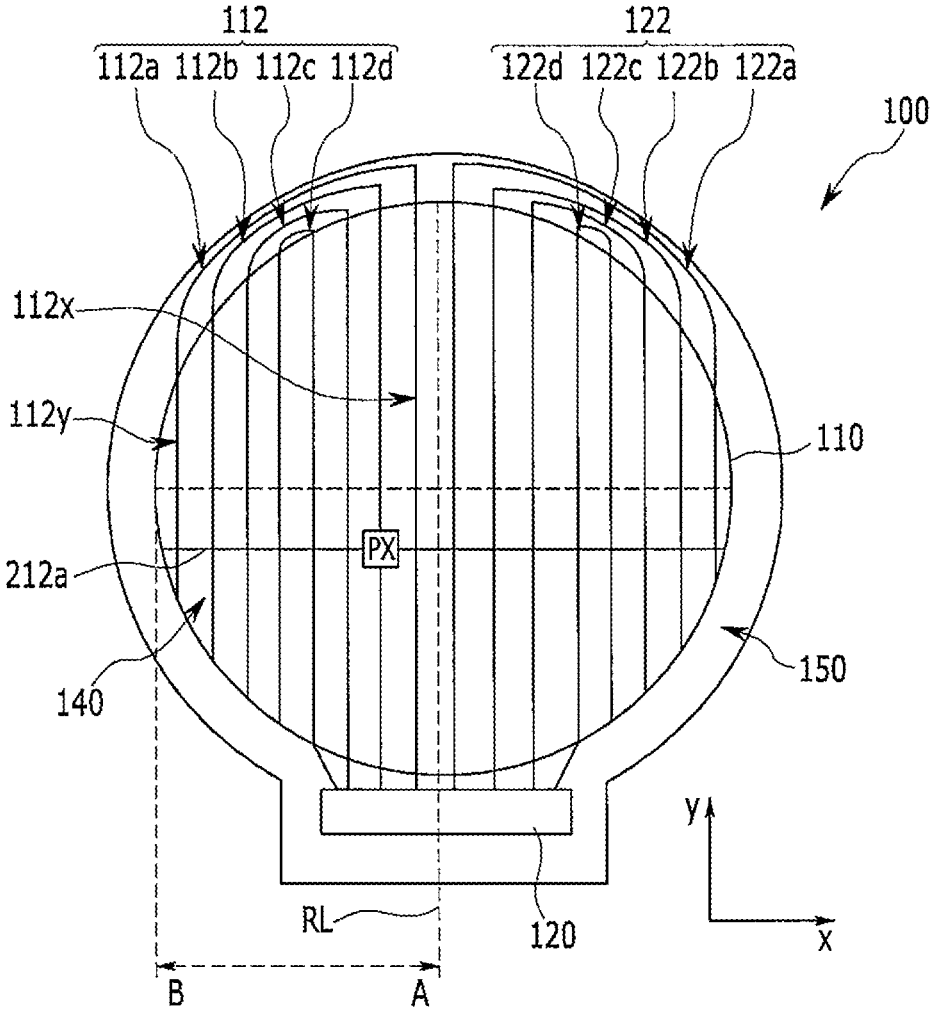
FIG. 1 is a diagram schematically illustrating data lines of a non-quadrangular display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

It will be understood that when an element or layer is referred to as being "on", "connected to", "connected with," or "coupled to" another element or layer, it may be directly on, connected, or coupled to or with the other element or layer or one or more intervening elements or layers may also be present. When an element is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements. In addition, unless explicitly described to the contrary, the words "comprise" and "include" and variations such as "comprises," "comprising," "includes," and "including," will be understood to imply the inclusion of stated elements but not the exclusion of any other elements.

As used herein, the term "and/or" includes any and all combinations of one or more of the associated listed items. Further, the use of "may" when describing embodiments of the present invention relates to "one or more embodiments of the present invention". Expressions, such as "at least one of," when preceding a list of elements, modify the entire list of elements and do not modify the individual elements of the list. Also, the term "exemplary" is intended to refer to an example or illustration.

The data driver, gate driver, and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the data driver and the gate driver may be formed on one integrated circuit (IC) chip or on separate IC chips. Further, the various components of the data driver and the gate driver may be implemented on a flexible printed circuit film, a tape carrier package (TCP), a printed circuit board (PCB), or formed on a same substrate as the data driver or the gate driver. Further, the various components of the data driver and the gate driver may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Hereinafter, a non-quadrangular display device according to an exemplary embodiment of the present invention will be described with reference to FIGS. 1 to 4.

FIG. 1 is a diagram schematically illustrating data lines of a non-quadrangular display device according to an exemplary embodiment of the present invention.

Referring to FIG. 1, a non-quadrangular display device 100 according to an exemplary embodiment of the present invention includes a non-quadrangular display panel 110, a plurality of data lines 112 and 122 (e.g., data lines 112*a*, 112*b*, 112*c*, 112*d*, 122*a*, 122*b*, 122*c*, and 122*d*) respectively transmitting data signals to pixels of the non-quadrangular display panel 110, and a plurality of gate lines crossing the data lines and respectively transmitting gate signals to the pixels of the non-quadrangular display panel 110.

A data driver 120 is connected with the plurality of data lines 112 and 122. Further, the data driver 120 drives the plurality of data lines 112 and 122 and applies a data signal to the pixels. Further, a gate driver is connected with the plurality of gate lines and drives the plurality of gate lines to apply a scan signal to the pixels.

A pixel PX connected to a gate line 212*a* and a data line 112*b* from among the plurality of pixels positioned in a display unit 140 is illustrated in FIG. 1. As illustrated in FIG. 1, the pixel PX may be electrically connected to the corresponding gate line 212*a* and data line 112*b* and may receive a gate signal through the gate line 212*a* and a data signal through the data line 112*b*.

Figure 2:
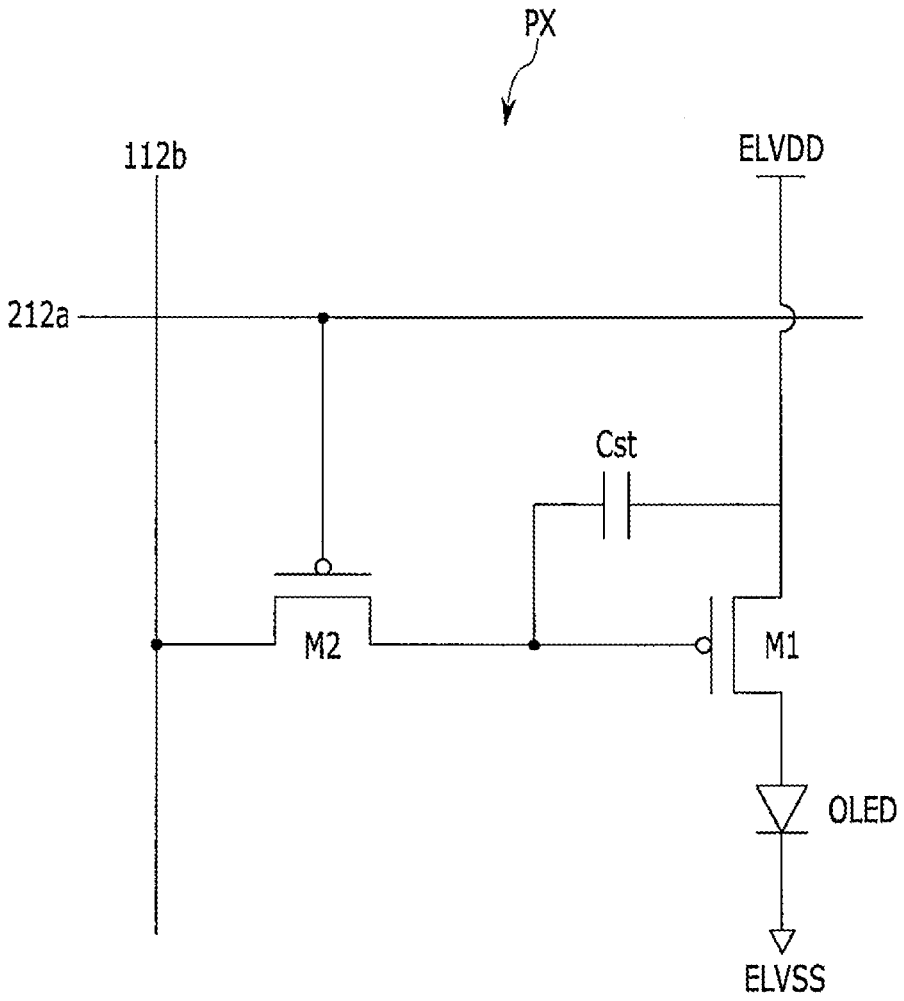
FIG. 2 is a diagram schematically illustrating a pixel according to an exemplary embodiment of the present invention.

FIG. 2 is a diagram schematically illustrating a pixel according to an exemplary embodiment of the present invention.

FIG. 2 illustrates the pixel PX including an organic light emitting diode (OLED), but the present invention is not limited thereto. The pixel PX may include a liquid crystal device (e.g., a liquid crystal layer) instead of an organic light emitting diode (OLED). Further, FIG. 2 illustrates a pixel circuit including a switching transistor M2, a driving transistor M1, and a capacitive device CST (e.g., a capacitor), but the pixel circuit for driving the organic light emitting diode (OLED) is not limited thereto.

As illustrated in FIG. 2, the switching transistor M2 includes a gate electrode connected to the gate line 212*a*, one electrode connected to the data line 112*b*, and the other electrode connected to a gate electrode of the driving transistor M1. A voltage ELVDD is supplied to one electrode of the driving transistor M1, and the capacitive device CST is connected between the gate electrode and one electrode of the driving transistor M1. The other electrode of the driving transistor M1 is connected to an anode electrode of the organic light emitting diode (OLED), and a cathode electrode of the organic light emitting diode (OLED) is connected to the voltage ELVSS.

The switching transistor M2 is turned on according to a gate signal supplied through the gate line 212*a*, the data signal supplied through the data line 112*b* is written in (e.g., provided to) the gate electrode of the driving transistor M1 during a turn-on period of the switching transistor M2, and the written voltage is maintained by the capacitive device CST.

Further, from among the plurality of data lines 112 and 122, a plurality of different parallel lines (e.g., two different parallel lines) are respectively connected to each other as one line (e.g., are connected to each other by curved line) and form data lines 112*a* to 112*d* and 122*a* to 122*d*, respectively. Further, first data lines 112*a* to 112*d* and second data lines 122*a* to 122*d* are symmetrically positioned (hereinafter, referred to as "similar symmetry") with respect to a reference line RL at a center area of the non-quadrangular display panel 110.

Further, from among the respective data lines 112*a* to 112*d* and 122*a* to 122*d*, two different parallel line (e.g., the data lines 112*x* and 112*y*, respectively) are connected to each other to form one data line 112*a* (e.g., to form a single data line 112*a*). In this embodiment, the first line 112*x* which is nearer to the reference line RL is connected with the second line 112*y* which is farther from the reference line RL to form the one data line 112*a*.

In this embodiment, a first pixel column from among the plurality of pixels may be positioned along the first line 112*x* and a second pixel column different from the first pixel column may be positioned along the second line 112*y*. Further, the one data line 112*a* may connect the first pixel column and the second pixel column.

Further, the non-quadrangular display device 100 according to an exemplary embodiment of the present invention may transmit a data signal to the plurality of pixels in the first pixel column and the second pixel column disposed along the two different parallel lines 112*x* and 112*y* through the one data line 112*a*.

Figure 3:
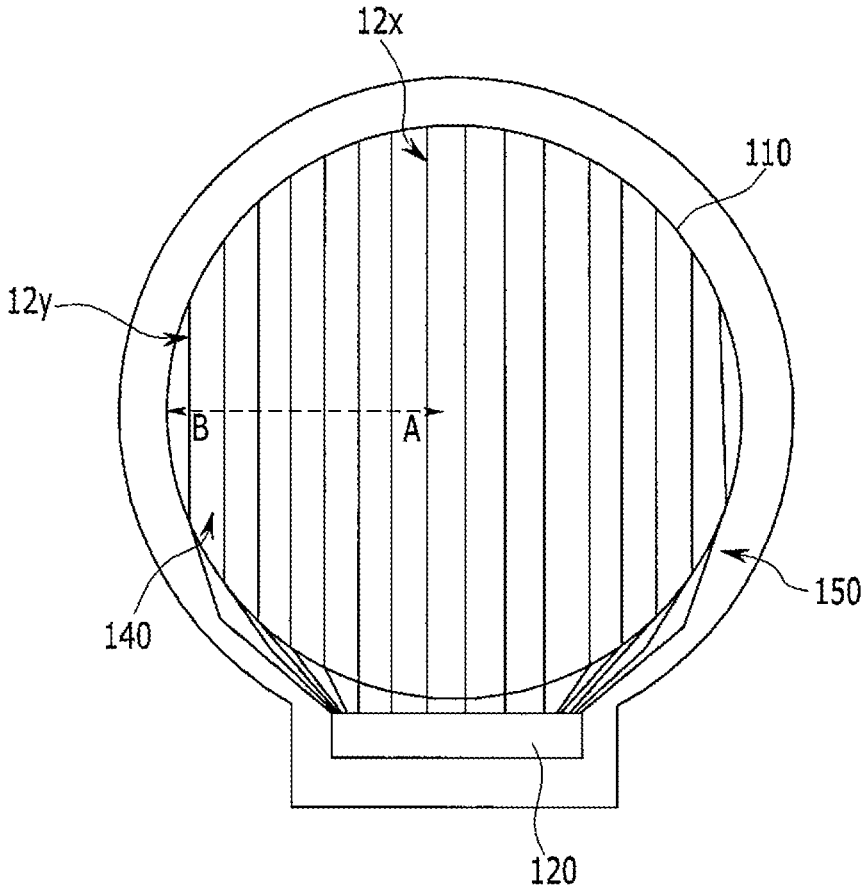
FIG. 3 is a diagram schematically illustrating data lines of a non-quadrangular display device according to a Comparative Example.

FIG. 3 is a diagram schematically illustrating data lines of a non-quadrangular display device according to a Comparative Example.

Referring to FIG. 3, in the non-quadrangular display device according to the Comparative Example, each of the data lines is connected with a data driver 120. Accordingly, in the non-quadrangular display device according to the Comparative Example, a length deviation between the respective data lines is relatively large, and a difference in the number of pixels connected to respective data lines is also relatively large.

For example, between a data line 12*x*, which is near to a center area A of a non-quadrangular display panel 110, and a data line 12*y* which is near to an outer area B of the non-quadrangular display panel 110, a large load deviation occurs due to a difference in the number of pixels connected to the respective data lines.

Accordingly, in the non-quadrangular display device 100 according to an exemplary embodiment of the present invention, which is illustrated in FIG. 1, two or more of the individual data lines are connected to each other to form single data lines 112*a* to 112*d*, respectively. Further, in the non-quadrangular display device 100 according to an exemplary embodiment of the present invention, to reduce or prevent a load difference between the data lines 112*a* to 112*d*, the data line 112*x* connected with the pixels near to the center area A of the non-quadrangular display panel 110 is connected with the data line 112*y* connected with the pixels near to the outer area B of the non-quadrangular display panel 110.

Further, through this configuration, the non-quadrangular display device 100 according to the exemplary embodiment of the present invention, the same data signal is transmitted to the pixels disposed at the center area A and the pixels disposed in the outer area B through respective ones of the data lines 112*a* to 112*d*, and a load deviation between the data lines 112*a* to 112*d* is reduced or minimized.

Further, the non-quadrangular display device 100 according to an exemplary embodiment of the present invention illustrated in FIG. 1 includes a circular display unit 140, in which the plurality of pixels is disposed, and a non-display unit 150 surrounding a peripheral area of the display unit 140.

The plurality of data lines 112 and 122 is connected with the data driver 120 disposed at one side of the non-quadrangular display panel 110, and each of the data lines 112 and 122 extends through the non-display unit 150 at a side of the non-quadrangular display panel 110 that is opposite to the side of the non-quadrangular display panel 110 at which the data driver 120 is disposed.

Figure 4:
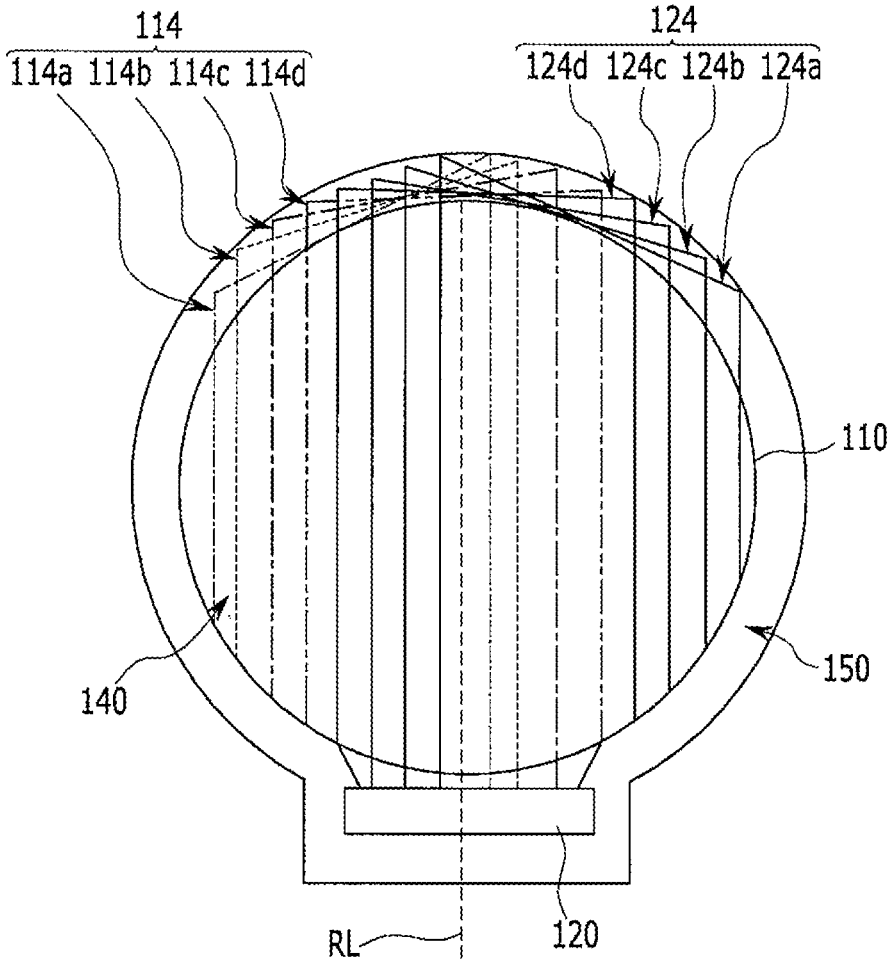
FIG. 4 is a diagram schematically illustrating data lines of a non-quadrangular display device according to another exemplary embodiment of the present invention.

FIG. 4 is a diagram schematically illustrating data lines of a non-quadrangular display device according to another exemplary embodiment of the present invention.

Referring to FIG. 4, in a non-quadrangular display device 100 according to another exemplary embodiment of the present invention, a data driver 120 is positioned in a non-display unit 150 at one side of the non-quadrangular display device 100 and a plurality of data lines 114 and 124 is connected to the data driver 120. Each of the plurality of data lines 114 and 124 is formed having at least two portions extending parallel to each other with a portion at the non-display unit connecting the at least two parallel portions.

Further, the plurality of data lines 114 may cross in the non-display unit 150 of a non-quadrangular display panel 110. The respective data lines 114*a* to 114*d* and 124*a* to 124*d* cross each other in the non-display unit 150 at a side opposite to the side at which the data driver 120 is disposed. Thus, pixels disposed along a plurality of parallel lines in the display unit 140 are respectively connected through one wire. Further, first data lines 114*a* to 114*d* and second data lines 124*a* to 124*d* may be symmetrically positioned with respect to a reference line RL at a center of the non-quadrangular display panel 110.

Further, each of the data lines 114*a* to 114*d* and 124*a* to 124*d* is formed by connecting one line which is near to a center area A of the non-quadrangular display panel 110 with one line which is near to an outer area B of the non-quadrangular display panel 110 to form one data line (e.g., a single data line).

As described above, in the non-quadrangular display device according to an exemplary embodiment of the present invention, a data line positioned at an outer portion of a circular panel in a circular display device is connected with a data line positioned at a center portion of the circular panel to form one data line, thereby reducing or minimizing a load difference between the various data lines due to differences in the number of pixels connected to each data line.

While this invention has been described in connection with what is presently considered to be practical exemplary embodiments, it is to be understood that the invention is not limited to the disclosed embodiments but is intended to cover various modifications and equivalent arrangements included within the spirit and scope of the appended claims and their equivalents.

What is claimed is:

1. A display device comprising:

a plurality of data lines;

a plurality of gate lines crossing the plurality of data lines;

an elliptical display panel comprising a plurality of pixels, each of the plurality of pixels being connected to one corresponding data line from among the plurality of data lines and one corresponding gate line from among the plurality of gate lines; and a data driver configured to supply a plurality of data signals to the plurality of data lines, wherein each of the plurality of data lines comprises a first portion that is connected to one pixel column and a second portion that is connected to another pixel column that is different from the one pixel column, wherein a number of pixels connected to the first portion is different from a number of pixels connected to the second portion, and wherein both of the first and second portions of one of the plurality of data lines are between first and second portions of another one of the plurality of data lines.

2. The display device of claim 1, wherein the elliptical display panel further comprises:

an elliptical display area, in which the plurality of pixels is disposed; and a non-display area surrounding a periphery of the display area.

3. The display device of claim 2, wherein:

at least one of the plurality of data lines connects the one pixel column and the other pixel column and extends through a portion of the non-display area.

4. The display device of claim 3, wherein:

at least one of the plurality of data lines connects the one pixel column and the other pixel column and extends through the non-display area at a side of the elliptical display panel that is opposite to a side of the elliptical display panel at which the data driver is located.

5. The display device of claim 1, wherein:

the one pixel column is nearer to a center of the elliptical display panel than the other pixel column.

6. The display device of claim 5, wherein:

the one pixel column is near the center of the elliptical display panel and the other pixel column is near an outer side of the elliptical display panel.

7. The display device of claim 1, wherein:

at least one of the plurality of data lines crosses another one of the plurality of data lines outside a periphery of the display panel and connects the one pixel column and the other pixel column.

8. The display device of claim 1, wherein:

the elliptical display panel is a circular display panel.

* * * * *